United States Patent [19]

Fraser, Jr. et al.

[11] Patent Number: 4,907,414

[45] Date of Patent: Mar. 13, 1990

[54] REFRIGERANT INJECTION INTO OIL FOR SOUND REDUCTION

[75] Inventors: Howard H. Fraser, Jr., Lafayette; Jacob A. Bayyouk, Clay, both of N.Y.

[73] Assignee: Carrier Corporation, Syracuse, N.Y.

[21] Appl. No.: 902,853

[22] Filed: Sep. 2, 1986

[51] Int. Cl.[4] ..... F25D 19/00

[52] U.S. Cl. ..... 62/56; 62/296; 181/403; 417/312

[58] Field of Search ..... 62/296, 56; 181/403; 417/312; 184/6.23

[56] References Cited

U.S. PATENT DOCUMENTS

| | | | |
|---|---|---|---|
| 1,897,199 | 2/1933 | Kenney | 62/296 X |
| 3,066,857 | 12/1962 | McCloy | 62/296 X |
| 3,147,914 | 9/1964 | Hatten et al. | 62/296 X |
| 3,155,312 | 11/1964 | Douglas | 62/296 X |
| 3,792,755 | 2/1974 | Sanvordenker | 417/312 X |

*Primary Examiner*—William E. Tapolcai

*Attorney, Agent, or Firm*—David J. Zobkiw

[57] ABSTRACT

In a low side hermetic compressor, a small portion of the compressed refrigerant gas is diverted and discharged into the oil sump through an orifice into the upper level of the oil in the sump. This results in a supersaturated solution of refrigerant in oil in the upper level which drives the refrigerant out of the oil, thereby creating froth which provides sound reduction without disturbing the lower level which remains stratified.

3 Claims, 2 Drawing Sheets

10
11
12
13
15
17
18
20
30
60

10
11
12
13
14
15
16
17
18
19
20
30
2
60

REFRIGERANT INJECTION INTO OIL FOR SOUND REDUCTION

BACKGROUND OF THE INVENTION

The radiated sound level of hermetic compressors, is of extreme importance since, in residential applications, they are typically located in a window opening or the yard. Of additional importance, is high performance of the compressor However, as compressor performance increases, the sound sources and paths are often altered resulting in unacceptable radiated sound levels. As a result, the twin goals of high performance and acceptable radiated sound levels are generally in conflict. Conventional sound reduction techniques such as the use of paddles on the oil pickup tube to generate a froth are often inadequate for high performance compressors.

SUMMARY OF THE INVENTION

In a low side hermetic compressor the compressed refrigerant discharged from the cylinders is directed to a muffler and then to the discharge line leading from the compressor. By diverting a small portion of the compressed refrigerant gas from a muffler body into the compressor oil, the oil is foamed which results in an attenuated path through which the sound must travel and a reduced radiated sound level. The nature of the foam generation is different than that generated by paddles. When paddles are used, the entrained refrigerant is removed from the oil and the oil is agitated by the stirring action of the paddles. In contrast, the present invention injects the high pressure refrigerant into the upper level of the oil without disturbing the lower level which remains stratified. This results in a supersaturated solution of refrigerant in oil in the upper level which drives the refrigerant out of the oil, thereby creating froth, since the inside of the shell of the compressor is at suction pressure. The lower level is undisturbed by all of this and remains a stable, saturated solution which is in equilibrium. Additionally, the upper level serves to dampen the effects of pressure drops on the lower level. The pressure drops are a normal consequence of compressor operation but can cause outgassing when the pressure is lowered. The dampening effect is because the froth is more sensitive to pressure changes than the lower level.

The length and placement of the orifice body as well as the size of the orifice are important. The orifice body should be vertically located in the lower portion of the muffler body with the refrigerant gas escaping downward. The orifice body should be of a sufficient length to extend a sufficient depth into the oil sump to permit the supersaturation of the oil with refrigerant. Also, the orifice body should provide a flow path of a sufficient length and relatively small cross section to shield the orifice from the pressure oscillations in the muffler body. The orifice itself should be of such a dimension as to prevent the discharge of too much refrigerant from the muffler while permitting sufficient foam generation. These combined design parameters allow proper sound attenuation without a significant loss in compressor performance.

It is an object of this invention to provide a method and apparatus for reducing radiated sound levels in hermetic compressors.

It is another object of this invention to provide a method and apparatus for foam generation. These objects, and others as will become apparent hereinafter, are accomplished by the present invention.

Basically, refrigerant at compressor discharge pressure is bled from the muffler through an orifice body and an orifice and discharges into the upper level of the oil in the sump. This creates a supersaturated solution at the upper level which causes refrigerant gas to be given off thereby creating foam or froth with a resultant reduction in radiated sound levels.

BRIEF DESCRIPTION OF THE DRAWINGS

For a further understanding of the present invention, reference should now be made to the following detailed description thereof taken in conjunction with the accompanying drawings wherein.

DESCRIPTION OF THE PREFERRED EMBODIMENT

Figure 2:
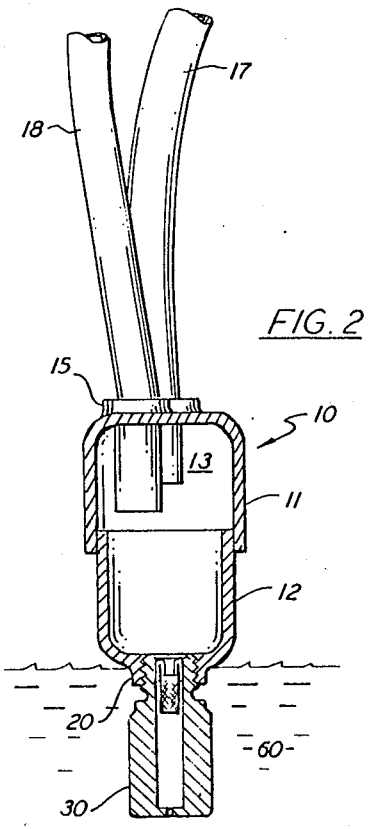
FIG. 2 is a sectional view taken along line 2-2 of FIG. 1.
Figure 1:
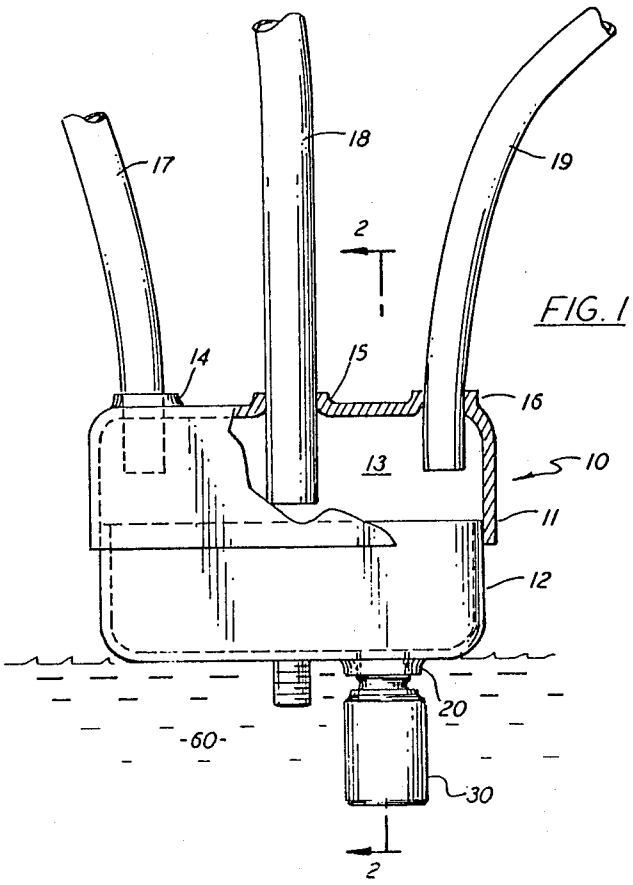
FIG. 1 is a partially cutaway view of a muffler assembly.
Figure 3:
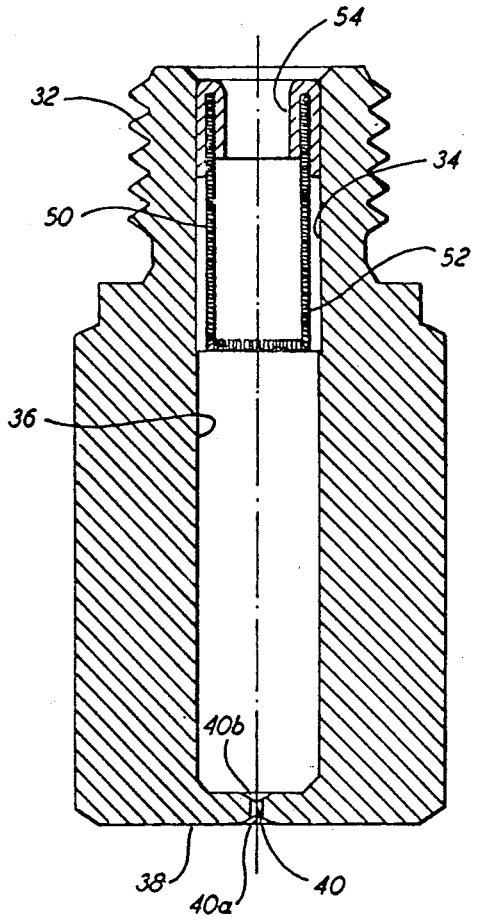
FIG. 3 is an enlarged sectional view of the orifice body and screen assembly shown in FIG. 2.

In FIGS. 1 and 2, the numeral 10 generally designates a muffler assembly for use in a hermetic compressor including a top portion 11 and a bottom portion 12 which are brazed or otherwise suitably joined together in a fluid tight manner to form chamber 13. Collars 14, 15 and 16 are formed in top portion 11 for respectively receiving header 17, discharge line 18 and header 19. Threaded collar 20 is formed in bottom portion 12 for threadably receiving orifice body 30. Referring now to FIG. 3, orifice body 30 has a threaded portion 32 for threadably engaging threaded collar 20. A first bore 34, a second bore 36 of a lesser diameter than bore 34 are serially formed in orifice body 30 and terminate at end wall 38. An orifice 40 extends through wall 38. A typical thickness for wall 38 is 0.06 to 0.07 inches and a typical diameter for orifice 40 is 0.013 to 0.016 inches. As illustrated, one or both ends 40 *a* and *b* of orifice 40 may be counterbored or tapered to a depth of 0.01 inches. A strainer assembly 50 is located in bore 34 and is made up of a screen material portion 52 and a ring portion 54 secured to the screen portion 52. The ring portion 54 is force fit into bore 34. The pores of the screen portion 52 are about half the size of the orifice 40 so as to prevent its being clogged.

In operation, as best shown in FIG. 1, the orifice body 30 extends vertically into the oil sump 60 for a distance of approximately one inch. In the illustrated two-cylinder configuration, compressed refrigerant from each of the compressor cylinders (not illustrated) is delivered to chamber 13 of muffler assembly 10 via headers 17 and 19, respectively. Most of the compressed refrigerant passes from chamber 13 via discharge line 18 which delivers the refrigerant to the condenser (not illustrated) of a refrigeration system. According to the teachings of this invention, a small portion of the compressed refrigerant passes from chamber 13 via orifice body 30. Specifically, refrigerant from chamber 13 passes into orifice body 30 and serially passes through screen material 52 which acts as a filter and into the chamber defined by bores 34 and 36 and passes through orifice 40 into the oil sump 60.

Since the refrigerant entering orifice 40 is at compressor discharge pressure while the refrigerant vapor above the oil sump 60 is at compressor suction pressure, the refrigerant discharged into the oil sump is injected into the upper level of the oil in sump 60 without disturbing the lower level. This results in a supersaturated solution of refrigerant in oil in the upper level of the oil in sump 60 which drives the refrigerant out of the oil and produces sound reducing froth due to the presence of suction pressure over the oil sump 60. The lower level is undisturbed by the injection of refrigerant and remains a stable saturated solution which is in equilibrium and dampened by the upper level from the effects of normal pressure fluctuations in operation.

Although a preferred embodiment of the present invention has been illustrated and described, other modifications will occur to those skilled in the art. It is therefore intended that the present invention is to be limited only by the scope of the appended claims.

What is claimed is:

1. A method for reducing radiated sound levels in low side hermetic compressors comprising the steps of:

supplying pressurized refrigerant to a muffler which is in fluid communication with a discharge line;

diverting a small portion of the pressurized refrigerant supplied to the muffler; and injecting the diverted pressurized refrigerant into an oil sump at a point beneath the surface of the oil whereby a supersaturated solution of refrigerant in oil is created in the upper level of the oil in the sump which drives the refrigerant out of the oil in the upper level to create a froth without disturbing the lower level of the oil in the sump.

2. The method of claim 1 wherein the step of injecting the diverted refrigerant takes place by discharging the diverted refrigerant downwardly in the sump at a distance of approximately one inch beneath the surface of the oil.

3. The method of claim 1 wherein the step of injecting the diverted refrigerant passes the diverted refrigerant through an orifice 0.013 and 0.016 inches in diameter.

* * * * *